US005375585A

United States Patent [19]

Home

[11] Patent Number: 5,375,585

[45] Date of Patent: Dec. 27, 1994

[54] COMBINATION OF A PIEZOELECTRIC IGNITER AND A SAFETY VALVE FOR A GAS RANGE

[76] Inventor: William Home, 9-3 Fl., No. 374, Sec. 2, Pa Teh Rd., Taipei, Taiwan, Prov. of China

[21] Appl. No.: 193,447

[22] Filed: Feb. 8, 1994

[51] Int. Cl.[5] ..... F24C 3/00

[52] U.S. Cl. ..... 126/39 E; 126/39 BA; 126/42; 431/256

[58] Field of Search ..... 126/39 R, 39 E, 39 AB, 126/41 R, 42, 39 G; 431/254–257

[56] References Cited

U.S. PATENT DOCUMENTS

| | | | |
|---|---|---|---|
| 2,115,007 | 4/1938 | Cabrera | 431/257 |
| 3,436,165 | 4/1969 | Gehrke | 431/256 |
| 3,477,797 | 11/1969 | Zielinski et al. | 431/256 |
| 4,003,360 | 1/1977 | Branson | 431/256 |

*Primary Examiner*—James C. Yeung
*Attorney, Agent, or Firm*—Welsh & Katz, Ltd.

[57] ABSTRACT

A gas range includes a burner, a burner control unit, a piezoelectric igniter and a safety valve. The safety valve is situated between a gas supply and the burner. A thermocouple is situated near the burner. The piezoelectric igniter is used to ignite gas which vents out of the burner. As a flame occurs at the burner, a temperature at the burner will ascend. The thermocouple detects the increased temperature and generates a current to open the safety valve. If the flame goes out, the temperature will descend to the predetermined value. The thermocouple detects the decreased temperature and stops generating any current to actuate the safety valve. Thus, the safety valve is closed so as to keep any gas from venting out of the burner.

1 Claim, 2 Drawing Sheets

COMBINATION OF A PIEZOELECTRIC IGNITER AND A SAFETY VALVE FOR A GAS RANGE

BACKGROUND OF INVENTION

The present invention relates to a gas range which has a piezoelectric igniter and a safety valve assembly.

For many years, gas ranges have been employed to cook food. Such a conventional gas range employs a burner and a valve. The burner is in fluid communication with a gas supply by means of the valve. When the valve is closed, gas is kept from venting out of the burner. When the valve is opened, gas is allowed to vent out of the burner. Conventionally, a separate igniter is used to ignite the gas which vents out of the burner, and this is inconvenient. Furthermore, most gas ranges do not employ any safety devices to close the valves when flees go out and resulting leakages of the gas might cause explosions. Some gas ranges employ some safety devices, however, none of them employs a combination of an igniter and a safety device. Therefore, there is a long and unfulfilled need for a convenient and safe gas range.

SUMMARY OF INVENTION

It is the primary object of the present invention to provide a convenient and safe gas range.

The primary object of the present invention is achieved by providing a gas range which has a burner, a burner control unit, a piezoelectric igniter and a safety valve. The safety valve is situated between a gas supply and the burner. A thermocouple is situated near the burner. The piezoelectric igniter is used to ignite gas which vents out of the burner. A temperature at the burner will ascend as a flame occurs at the burner. The thermocouple will detect the increased temperature and generates a current to open the safety valve. If the flame goes out, the temperature will descend to the predetermined value. The thermocouple will detect the decreased temperature and stops generating any current to actuate the safety valve. The safety valve is thus closed in order to keep any gas from venting out of the burner.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
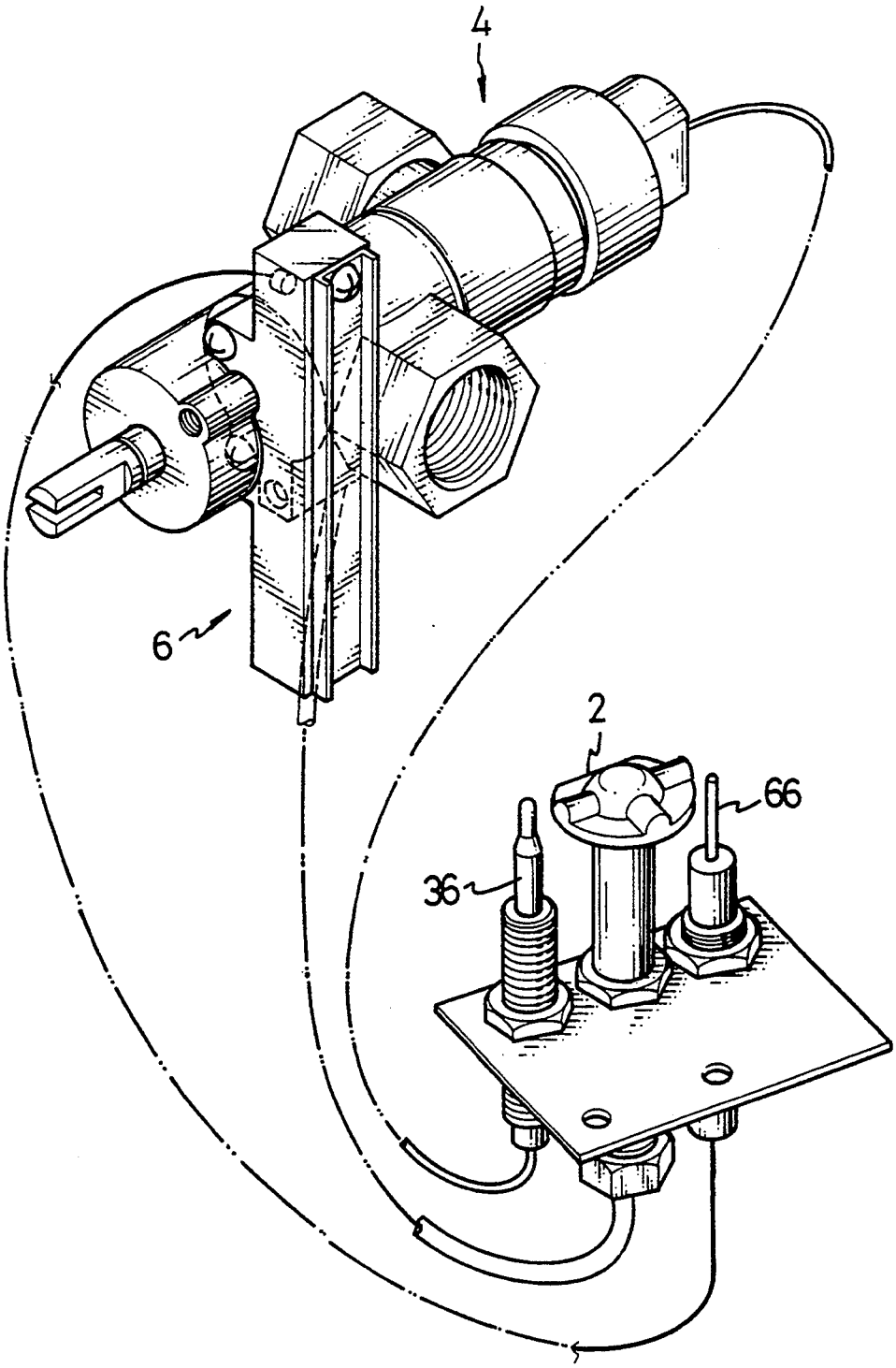
FIG. 1 is an isometric view of a piezoelectric igniter and a safety valve in accordance with the preferred embodiment of the present invention, further showing a central burner.

Referring to FIG. 1, in accordance with the preferred embodiment of the present invention, a gas range (not shown) employs a central burner 2, a safety valve assembly 4 and a piezoelectric igniter 6. The central burner 2 is in fluid communication with a gas supply (not shown), by means of the safety valve assembly 4.

When the safety valve assembly 4 is opened, gas is allowed to vent out of the central burner 2. The gas which vents out of the central burner 2 can be ignited by means of the piezoelectric igniter 6.

Figure 3:
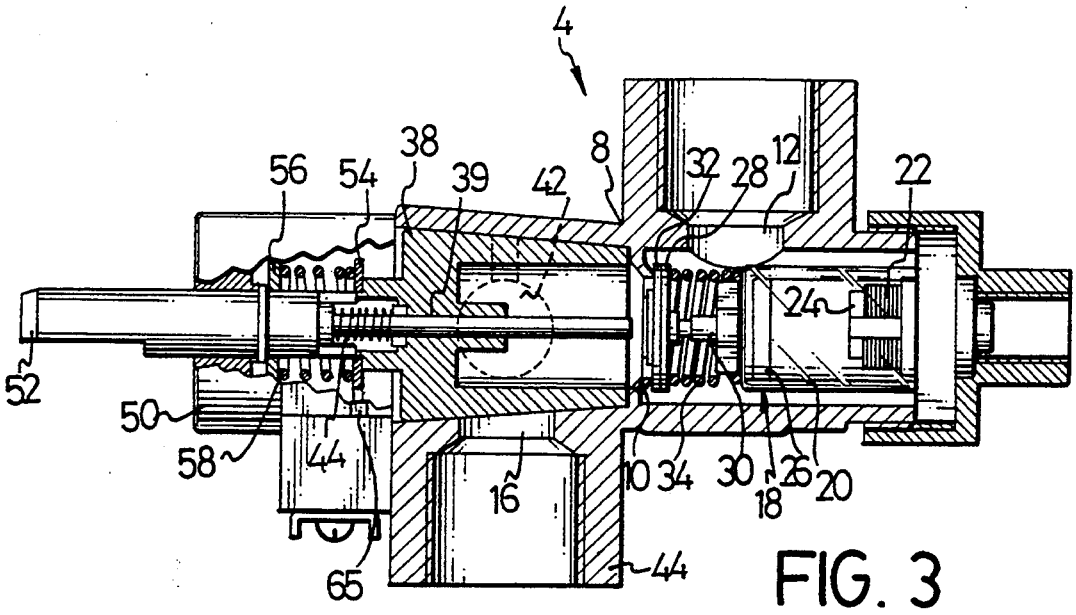
FIG. 3 is a partly cross-sectional view taken along a line 3—3 in FIG. 2.
Figure 4:
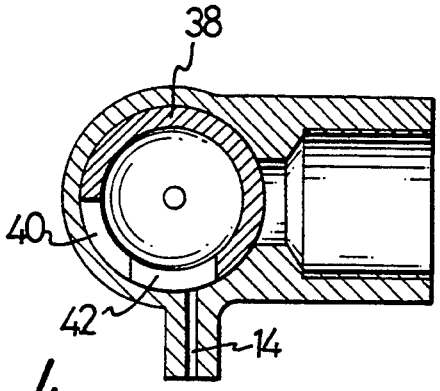
FIG. 4 is a cross-sectional view taken along a line 4—4 in FIG. 2.

Referring to FIGS. 3 and 4, the safety valve assembly 4 has a valve housing 8 with an outer surface and an inner surface on which an annular flange 10 is formed so as to divide the valve housing 8 into a first section and a second section. An inlet 12 is formed in the first section of the valve housing 8. A first outlet 14 and a second outlet 16 are formed in the second section of the valve housing 8. The outlets 14 and 16 are at an angle of 90° from each other. The inlet 12 is in fluid communication with the gas supply by means of a pipe (not shown). The first outlet 14 is in fluid communication with the central burner 2 (see FIG. 1). The second outlet 16 is in fluid communication with an annular burner (not shown).

An electro-magnetic valve 18 is disposed in the first section of the valve housing 8. The electro-magnetic valve 18 comprises a shell 20, a coil 22 which is disposed in the shell 20, two electric magnets 24 which are enclosed in the coil 22, a ferromagnetic disk 26 which is disposed in the shell 20, a disk 28 which is disposed outside the shell 20, a mandrel 30 which is inserted through a hole, which is axially defined through the shell 20, in order to connect the ferromagnetic disk 26 with the disk 28, a gasket 32 which is attached to the disk 28 and a spring 34 which is compressed between the disks 26 and 28. The mandrel 30 has an end which is fixed to the ferromagnetic disk 26 and an opposite end which is shaped as a spherical end (not shown). The disk 28 has a side on which a hub is formed and an opposite side on which a protrusion is formed. The spherical end of the mandrel 30 is received in the hub of the disk 28. The hub of the disk 28 is deformed so as to retain the spherical end of the mandrel 30 in the hub of the disk 28. Thus, the disk 28 is actively linked to the mandrel 30. The gasket 32 is annular in order to be mounted on the protrusion of the disk 28. The protrusion of the disk 28 has an enlarged end so as to retain the gasket 32 to the disk 28. The coil 22 is operatively connected to a thermocouple 36 (see FIG. 1) which is arranged near the central burner 2.

A mechanical valve 38 is disposed in the second section of the valve housing 8. The mechanical valve 38 consists of a periphery, an end wall which is formed at an end of the periphery and a hub which is formed on a side of the end wall. A slot 40 is defined through the perimeter wall of the mechanical valve 38 and circumferentially extends along the periphery of the mechanical valve 38 for 90° for instance. A hole 42 is defined through the periphery of the mechanical valve 38. A hole 39 is axially defined through the end wall of the mechanical valve 38. Two cutouts are defined in the hub of the mechanical valve 38. A stem 44, which has a relatively large end, is inserted through the hole 39. A spring 48 is mounted on the stem 44 so as to be compressed between the end wall of the mechanical valve 38 and the enlarged end of the stem 44.

A burner control unit comprises a shell 50 which is attached to the valve housing 8 by means of several screws. A shaft 52 has a flat end and a D-shaped end (as shown axially). The flat end of the shaft 52 is engaged with the cutouts which are formed in the hub of the mechanical valve 38. The D-shaped end of the shaft 52 is received in a knob (not shown) for controlling the supply of gas. A limit is formed on the shaft 52 in order to retain the flat end of the shaft 52 in the shell 50. A ring 54, from which a finger 55 radially projects, is mounted on the hub of the mechanical valve 38. A washer 56 is mounted on the flat end of the shaft 52 against the limit. A spring 58 is compressed between the ring 54 and the washer 56.

Figure 2:
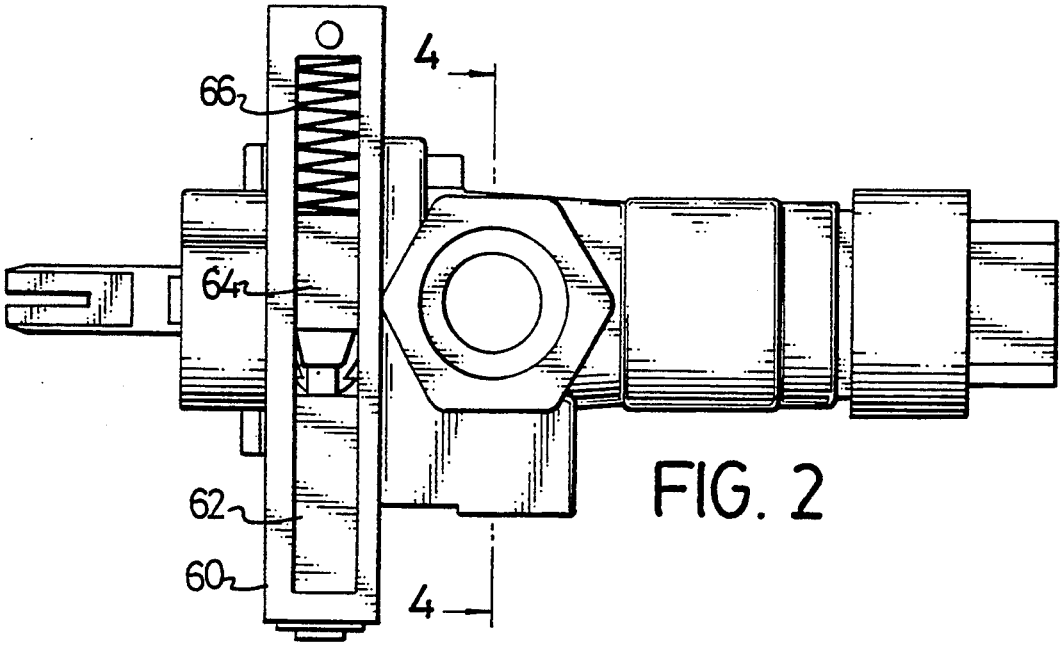
FIG. 2 is a side view of the piezoelectric igniter and the safety valve assembly shown in FIG. 1.

Referring to FIG. 2, the piezoelectric igniter 6 has a frame 60 which is integrally formed on the housing 50. A piezoelectric ceramic component 62 is received in the frame 60. A metal striker 64, from which a trigger 65 (see FIG. 3) transversely projects, is received in the frame 60. A spring 66 is received in the frame with an upper end attached to an upper end of the frame 60. The metal striker 64 is biased toward the piezoelectric ceramic component 62 by means of the spring 66.

To actuate the gas range, the knob is axially pressed so as to disengage the gasket 32 from the annular flange 10 by means of the stem 44. Thus, the first section of the valve housing 8 is in fluid communication with the space which is defined in the mechanical valve 38 by means of a hole 11 which is defined in the annular flange 10. The mechanical valve 38 is in a position as shown in FIGS. 3 and 4, so that the hole 42 is in fluid communication with the first outlet 14. That is, gas is allowed to flow from the gas supply to the central burner 2 by means of the safety valve 4.

As the knob is rotated, the mechanical valve 38 is rotated by means of the engagement of the flat end of the shaft 52 with the cutouts which are formed in the hub of the mechanical valve 38. Simultaneously, the ring 54 is rotated as it is mounted on the hub of the mechanical valve 38. As the ring 54 is rotated to a first position, the finger 55 engages with the trigger 65, so that the ring 54 moves the metal striker 64 from the piezoelectric ceramic component 62 while the metal striker 64 compresses the spring 66. As the ring 54 is rotated to a second position, the finger 55 is disengaged from the trigger 65. The spring 66 biases the metal striker 64 to strike the piezoelectric ceramic component 62 so as to produce a high voltage. The high voltage is then induced by means of a wire to an electrode 66 (see FIG. 1) which is disposed near the central burner 2. An electric spark occurs between the central burner 2 and the electrode 66 so as to ignite the gas which vents out of the central burner 2. As the ring 54 is in the second position, the hole 42 is slightly in fluid communication with the second outlet 16, so that gas flows from the gas supply to the annular burner by means of the valve assembly 4. The gas which vents out of the annular burner is ignited by means of the pilot flame which occurs at the central burner 2. To enlarge the flame which occurs at the annular burner, the mechanical valve 38 is further rotated so as to increase the alignment of the hole 42 with the second outlet 16. During the rotation of the mechanical valve 38, the first outlet 14 is always in fluid communication of the hole 42 or of the slot 40 so that gas is allowed to flow from the gas supply to the central burner 2.

The flame which occurs at the central burner 2 will increase the temperature which is detected by means of the thermocouple 36. As the temperature reaches a predetermined value, the thermocouple 36 generates a current in order to actuate the electric magnets 24 to attract the ferromagnetic disk 26, thus disengaging the gasket 32 from the annular flange 10 while compressing the spring 34. That is, gas is still allowed to flow through the mechanical valve 38 when the stem 44 is released.

If the flame which occurs at the central burner 2 goes out, the temperature will be reduced which is detected by means of the thermocouple 36. As the temperature descends to the predetermined value, the thermocouple 36 stops generating a current, thereby allowing the spring 34 to push the gasket 32 against the annular flange 10. That is, gas is kept from flowing through the safety valve 4, thus avoiding a potential hazard to health by the gas.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A gas range comprising:

a burner assembly comprising a central burner and an annular burner situated around the central burner; a safety valve assembly comprising:

a valve housing comprising an annular flange formed on an inner side of the valve housing so as to divide the valve housing into a first section and a second section, the first section of the valve defining an inlet through which gas can be directed into the first section of the valve housing from a gas supply, the second section of the valve housing defining a first outlet through which gas can be directed from the second section of the valve housing to the central burner and a second outlet through which gas can be directed from the second section of the valve housing to the annular burner;

and electro-magnetic valve received in the first section of the valve housing so that the electro-magnetic valve is engaged with the annular flange thus blocking gas from the first section of the valve housing to the second section of the valve housing when the electro-magnetic valve is not actuated and that the electro-magnetic valve is disengaged from the annular flange thus allowing gas from the first section of the valve housing to the second section of the valve housing when the electromagnetic valve is actuated;

a mechanical valve which is rotatably received in the second section of the valve housing and comprises an end wall, a periphery projecting from a side of the end wall and a hub protruding from an opposite side of the end wall, the end wall of the mechanical valve defining a central hole, the periphery of the mechanical valve defining a slot and an aperture at an end of the slot, the hub of the mechanical valve defining two cutouts;

a stem comprising a body and a head whereby the body of the stem is insertable through the central hole defined through the end wall of the mechanical valve; and a spring compressed between the end wall of the mechanical valve and the head of the stem;

a piezoelectric igniter comprising a frame attached to the valve housing, a piezoelectric ceramic component received in the frame, a metal striker which is received in the frame above the piezoelectric ceramic component and comprises a trigger transversely projecting therefrom and a spring received in the frame above the metal striker in order to bias the metal striker against the piezoelectric ceramic component;

a ring which is attached to the hub of the mechanical valve and comprises a finger radially projecting therefrom;

a burner control unit comprising a shaft comprising an annular shoulder and a flat end which axially projects from the annular shoulder and is slidably received in the cutouts defined in the hub of the mechanical valve, a washer mounted on the flat end of the shaft against the annular shoulder of the shaft, and a spring compressed between the ring and the washer; and a thermocouple which is mounted near the central burner and connected to the electro-magnetic valve;

whereby the shaft can be pressed so as to push the stem in order to disengage the electro-magnetic valve from the annular flange formed in the valve housing, the shaft can be rotated so as to rotate the ring in order to pull the trigger of the metal striker of the piezoelectric igniter, the mechanical valve is rotated so that the aperture thereof is moved from the first outlet to the second outlet as the shaft is rotated, the thermocouple actuates the electro-magnetic valve when the thermocouple detects that a temperature at the central burner reaches a predetermined value.

* * * * *